US005803350A

United States Patent [19]

Benet

[11] Patent Number: 5,803,350

[45] Date of Patent: Sep. 8, 1998

[54] BEVERAGE CONTAINER WITH PULL TAB SPOUT

[76] Inventor: Harry Benet, 2675 Ocean Ave., Brooklyn, N.Y. 11229

[21] Appl. No.: 876,075

[22] Filed: Jun. 13, 1997

[51] Int. Cl.[6] ..... B65D 43/00

[52] U.S. Cl. ..... 229/160.2; 229/125.42; 229/249

[58] Field of Search ..... 229/125.42, 160.2, 229/249

[56] References Cited

U.S. PATENT DOCUMENTS

| | | | |
|---|---|---|---|
| 2,113,481 | 4/1938 | Kasdorf | 229/125.42 X |
| 2,158,097 | 5/1939 | Wentz | 229/125.42 X |
| 4,166,566 | 9/1979 | Hamilton | 229/125.42 X |

FOREIGN PATENT DOCUMENTS

| | | | |
|---|---|---|---|
| 1966-08 | 1/1965 | France | 229/125.42 |
| 1942-03 | 3/1942 | Sweden | 229/125.42 |
| 1953-03 | 3/1953 | United Kingdom | 229/125.42 |
| WO 94/25352 | 10/1994 | WIPO | 229/125.42 |

*Primary Examiner*—Allan N. Shoap
*Assistant Examiner*—Tri M. Mai
*Attorney, Agent, or Firm*—Schweitzer Cornman Gross & Bondell LLP

[57] ABSTRACT

An opening aid for a beverage container with a reservoir and a folding gabled top provides a convenient means to break the initial seal of the top and provides and extension of the pouring spout formed by the top. The opening aid is hingedly connected to at least one the panels of the gabled top and is adapted to fold into the gabled top to permit initial sealing and closure of the container. The opening aid has an extended position forming an extension of said pouring spout to aid in fluid flow.

9 Claims, 8 Drawing Sheets

BEVERAGE CONTAINER WITH PULL TAB SPOUT

FIELD OF THE INVENTION

This invention pertains to the field of disposable beverage containers, and in particular, to beverage containers with folding gabled tops forming pouring spouts.

BACKGROUND OF THE INVENTION

It is well known to provide a disposable beverage container for liquids such as milk, orange juice and the like, with a folding gabled top portion which, when partially unfolded, forms an acceptable pouring spout. This type of known container is typically inexpensively formed from a blank of paper or cardboard which is cut, scored, folded and sealed to form a reservoir and the gabled top portion. After filling the container, the gabled top is folded closed along the score lines and hermetically sealed to permit transportation and to ensure freshness of the contents.

The score lines in the gabled top define panels which form the spout when the top is partially unfolded. The front of the spout is typically formed by a center panel, two side panels and a front sealing portion extending thereabove. The center panel is an equilateral triangle with the apex adjacent the top and center of the spout. The two side panels are isosceles right triangles joined to opposite sides of the center panel along their respective hypotenuses. This configuration forms a relatively horizontal top edge along which the front sealing portion extends. The rear of the spout is formed by two rear panels similar in shape to the side panels. The rear panels are joined to the side panels along score lines. Extending above the rear panels are rear sealing portions, and upper sealing portions projecting upwardly from the rear sealing portions.

When in the closed sealed position, the gabled top is folded inward along the score lines such that the front sealing portion is in contact with the rear sealing portions and such that opposed sections of the front sealing portion are in contact with one another. In addition, when in the closed position, the upper sealing portions extending from the rear panels are in direct contact.

Initially, portions of the contacting sealing portions are pressed together and hermetically sealed to one another to prevent spillage of the contained liquid during transportation and to preserve freshness. Thus, to open the spout, the seals must be forcibly broken. The process of initially opening the spout requires two steps. First, the side panels are separated by breaking the seal between the opposed sections of the front sealing portion and by breaking the direct seal between sealing portions connected to the rear panels. This is typically easily done by horizontally pulling apart the side panels. Second, the seal between the front and rear sealing portions must be broken to extend the spout forward. Sometimes this second step can be accomplished by bending the side and rear panels backward while compressing their score joints together and pulling forward. However, this is a complex movement which can be difficult, and in some cases impossible, to perform. Alternatively, an object, such as a knife or fork, can be inserted between the front and rear sealing portions; however this is awkward and inconvenient.

Several prior U.S. Patents describe containers with devices to aid in the process of initially opening of spout, as described above. U.S. Pat. No. 3,450,328 to Barrett describes a strip of tape attached to the center and side panels, where the strip has a projection which can be grasped to pull the center and side panels forward. U.S. Pat. No. 3,520,464 to Pugh, Sr. describes a paper ring attached to the center panel for the same purpose. U.S. Pat. No. 4,821,950 to Sanchez et al. describes a ring connected to a string attached to the interior of the container, which ring can be pulled to aid in breaking the seal of the spout. U.S. Pat. No. 4,883,222 to Fujisawa describes a flap or loop attached to the front sealing portion which can be grasped to pull the spout open. U.S. Pat. No. 5,516,037 to Okamoto et al. describes a similar tab connected to the center and side panels. U.S. Pat. No. 5,503,327 describes an integral tab extending upwardly from the front sealing portion above one of the side panels, which tab can be pulled to partially open the spout. The complete disclosures of the above references provide a useful background to the art of opening aids for gabled top disposable containers and are therefore incorporated herein by reference.

While the above prior art devices aid in initially opening the spout, they can be costly to manufacture. In addition, the prior designs do not improve upon the pouring spout formed by the partially unfolded gabled top. Therefore, what is desired is a gabled top disposable container with an opening aid which, in addition to assisting in the initial opening of the spout, improves the pouring spout for the life of the container.

The present invention improves upon known prior devices by providing an opening aid which also serves to enhance the pouring spout of the container. Specifically, the invention comprises a disposable gabled top container, generally of the type described above, which includes an opening aid extending upwardly from the front of the spout. The opening aid has panels hingedly connected to the front of the spout and is adapted to fold downward against the side and center panels to allow closure (and initial sealing) of the container. To initially open the container, the side panels are horizontally pulled apart to break the seal therebetween and the opening aid is pulled forward to break the seal between the side and rear panels. Then, the panels of the opening aid is folded upwardly to form an extension of the spout and improve the flow of liquid. To close the container, the opening aid is folded downward, against the side and center panels; the gabled top is then folded closed in an otherwise known manner.

DETAILED DESCRIPTION OF THE INVENTION

Figure 1:
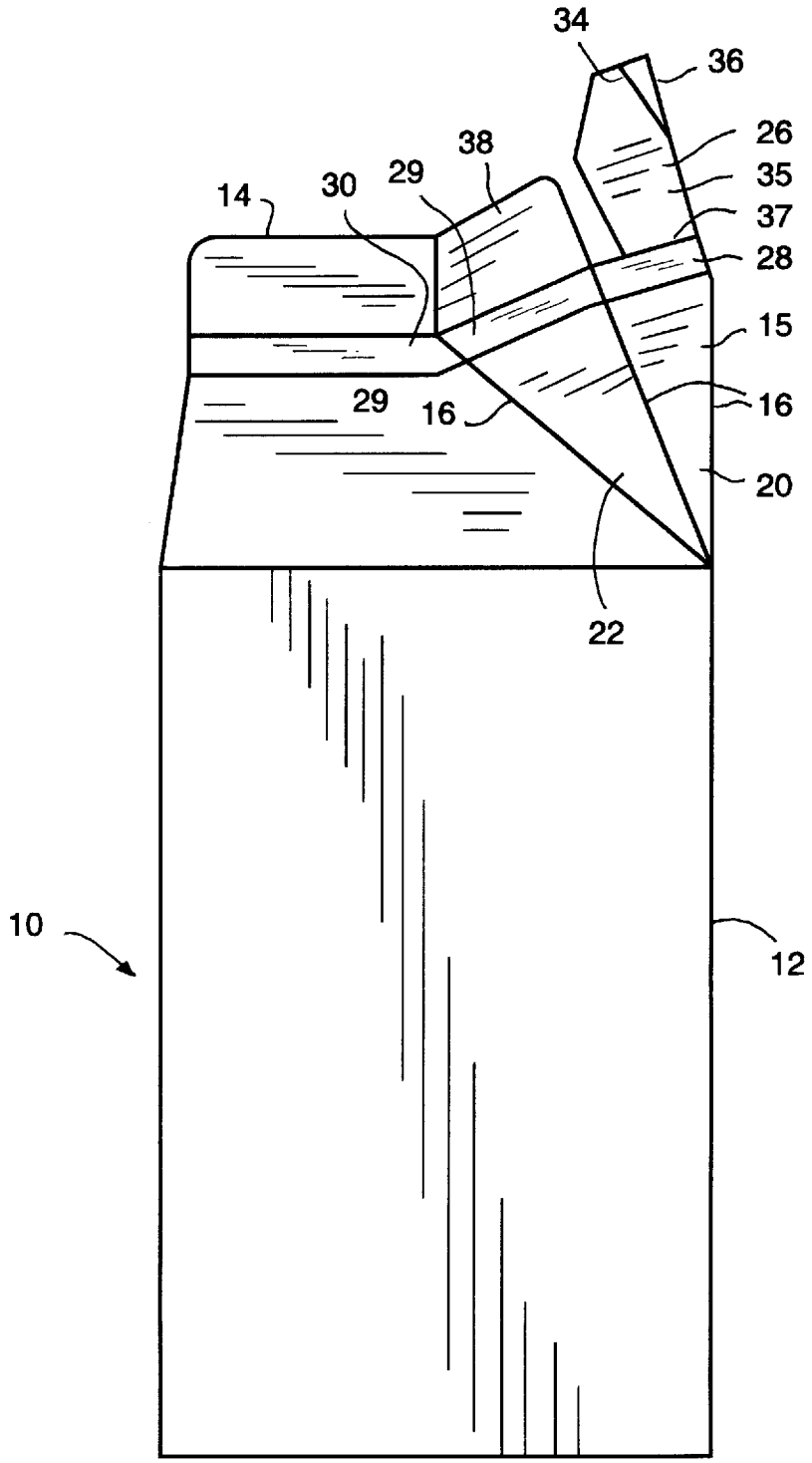
FIG. 1 is a side elevational view of a first embodiment of the container of the present invention, showing the opening aid in an extended position.
Figure 2:
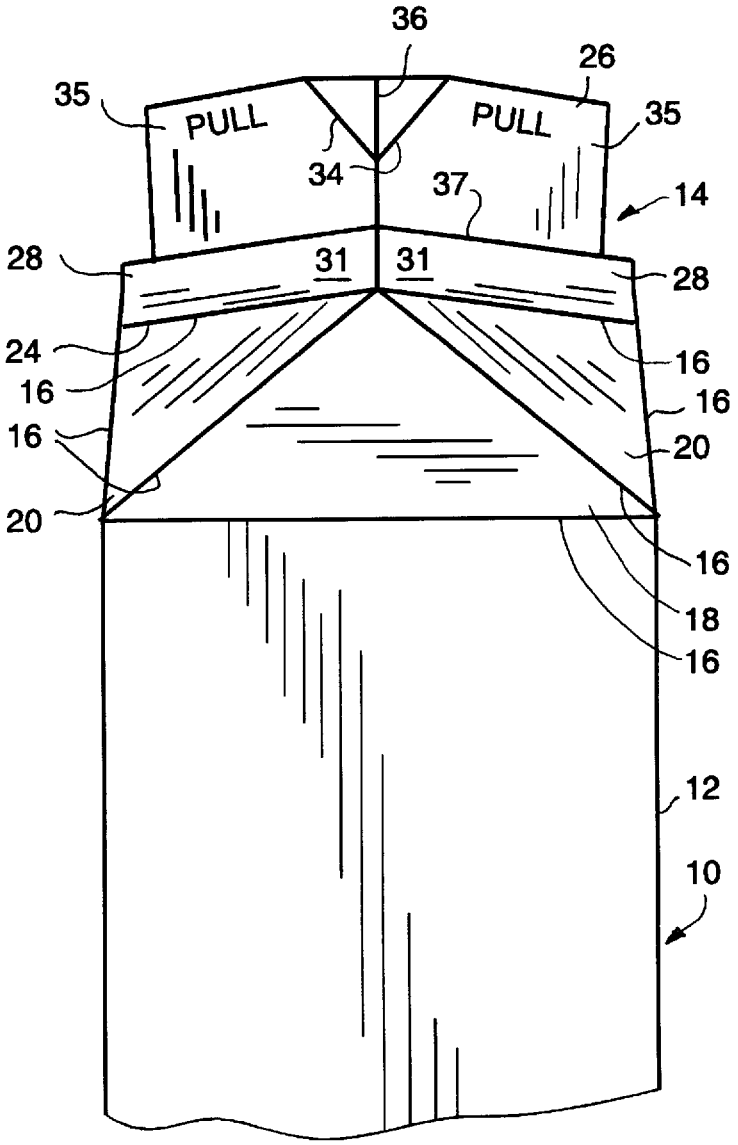
FIG. 2 is a front elevational view of the upper portion of the container of FIG. 1.
Figure 3:
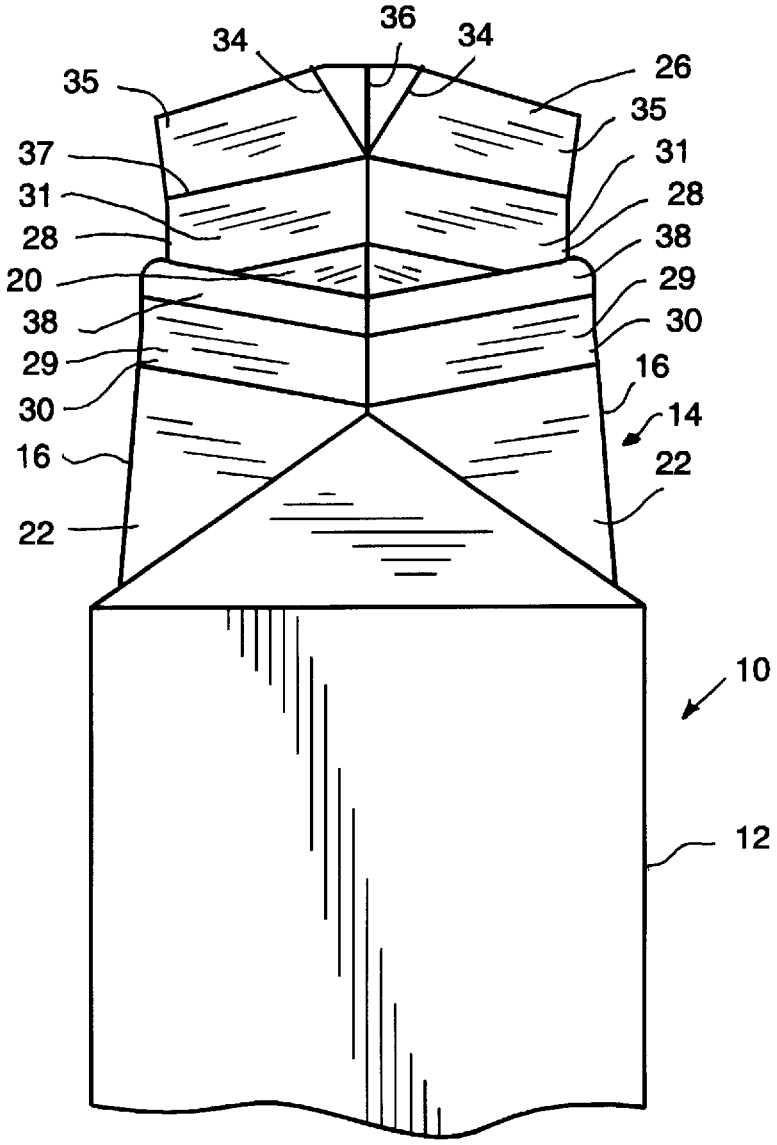
FIG. 3 is a rear elevational view of the upper portion of the container of FIG. 1.

Referring to the drawings, and initially to FIGS. 1–4 thereof, the novel container 10 of the present invention includes a reservoir portion 12 and a gabled top 14, which top forms a spout 15 when unfolded, as shown. The gabled top 14 includes a number of score lines 16 which define a center panel 18 and two side panels 20, which together form the front of the spout 15. The score lines 16 also define two rear panels 22 which form the rear of the spout 15. The panels 18, 20, and 22 are hingedly interconnected along the common score lines 16.

The center panel 18 is generally of the shape of an equilateral triangle with an apex oriented upwardly. The side panels 20 are generally of the shape of isosceles right triangles joined to opposite sides of the center panel 18 along their respective hypotenuses. This configuration forms a relatively horizontal top edge 24, attached to which are two rectangular-shaped, forward end panels 28, forming a forward sealing portion 31. When the spout 15 is open, the end panels 28 are aligned at an angle to each other, forming a substantially V-shaped apex at the front of the pouring spout 15. Absent the opening aid 26, the forward end panels 28 would form the end of the spout 15. corresponding rear end panels 29 extend upward from rear panels 22, forming a rear sealing portion 30. Upper sealing portions 38 project above the rear end panels 29.

Figure 4:
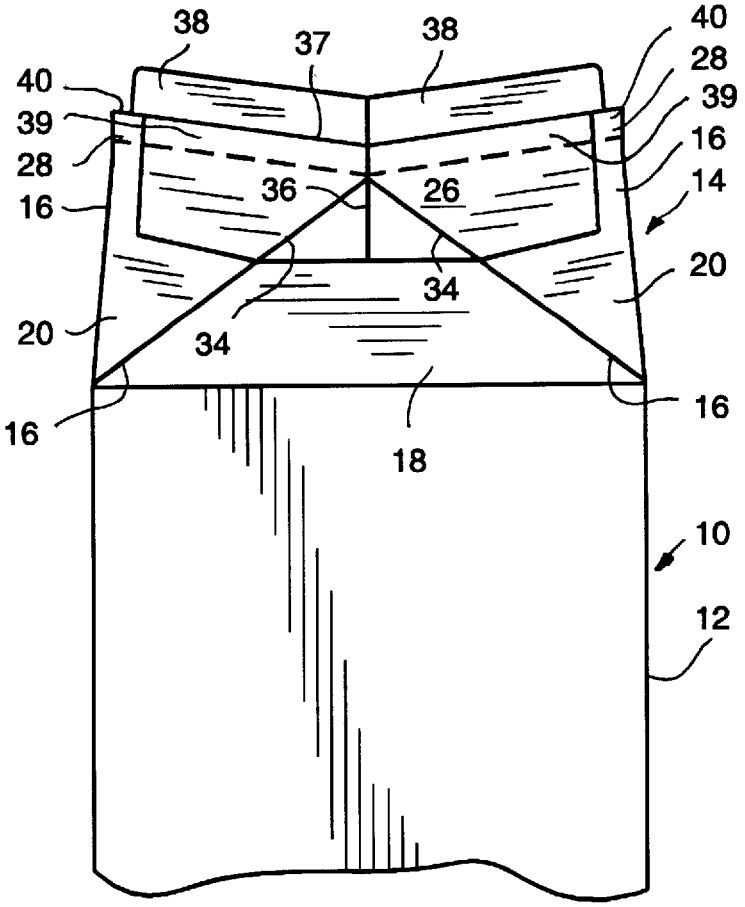
FIG. 4 is a front elevational view of the upper portion container of FIG. 1, showing the opening aid in a folded position.

The opening aid 26 is hingedly connected to the end panels 28 and comprises a pair of extending panels 35 joined to the end panels 28 through score lines 37. Initially, the extending panels 35 are gently folded against the panels 18, 20 as depicted in FIG. 4. To open the container, the side panels 20 are separated and then the opening aid 26 is pulled outwardly thereby breaking the seal between the forward and rear sealing portions 30, 31. Thus, the invention provides a convenient and comfortable means to initially open the spout 15. In addition, when unfolded, the opening aid 26 forms and extension of the spout 15 to improve liquid flow.

The opening aid 26 includes score lines 34 which allow the opening aid 26 to fold into the gabled top 14 (as depicted in FIG. 4) when closed. In addition, a center score line 36 allows the opening aid to assume a V-shape to provide rigidity for the opening aid 26 when in the extended position thereby allowing the opening aid 26 to support liquid flowing thereover. Thus, the opening aid 26 is preferably formed of a semi-rigid material and can be integrally formed with the container 10. The score lines 34, 36 define the panels which comprise the opening aid 26 and are positioned to align with the score lines 16 when the opening aid 26 is folded downward.

As with prior designs, when initially sealed, the forward and rear joined sealing portions 30, 31 are in sealing contact and the upper sealing portions 38 (extending upwardly from the rear sealing portions 30) are in direct contact. However, when in the downwardly folded position required for closing, the opening aid 26 partially covers the outward surfaces of the end panels 28, which end panels 28 would ordinarily seal to one another in prior designs. Therefore, the opening aid 26 preferably includes opposed sealing portions 39 (shown in FIG. 4) which contact and seal to one another, thereby strengthening the bond of the gabled top 14. Also, the opening aid 26 can seal to the partially covered outward surfaces of the end panels 28. If the opening aid 26 does not extend the full length of the end panels 28, 30 (as shown), the end panels 28 can include opposed sealing portions 40, which seal to one another in a similar manner to prior designs.

Thus, the process of initially opening the spout 15 first involves separating the side panels 20 by breaking the seal between the upper sealing portions 38 connected to the rear panels 22, the opposed portions 39 of the folded opening aid 26, and the opposed portions 40 of the end panels 28. This is typically easily done in a known manner by horizontally pulling apart the side panels 20. Second, the seal between the front and rear sealing portions 30, 31 must be broken to extend the spout forward. To accomplish this second step, the opening aid 26 is pulled forwardly and upwardly in a convenient and comfortable manner, thereby breaking the seal between the front and rear sealing portions 30, 31 forming the spout 15.

Figure 5:
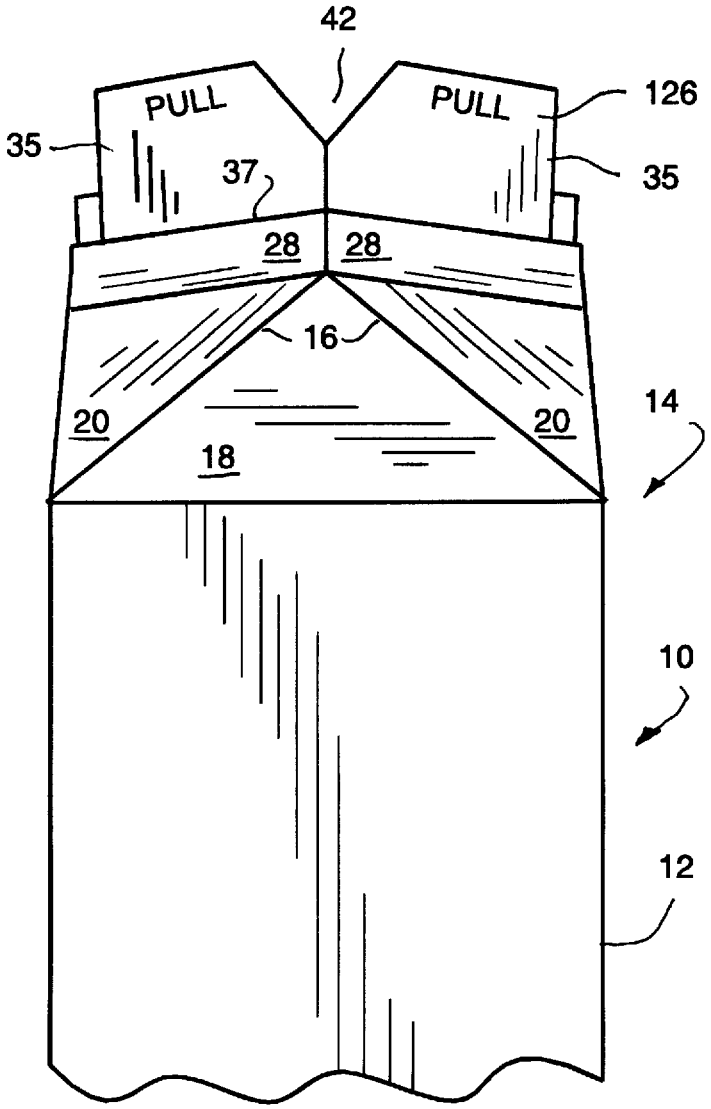
FIG. 5 is a front elevational view of an upper portion a second embodiment.
Figure 6:
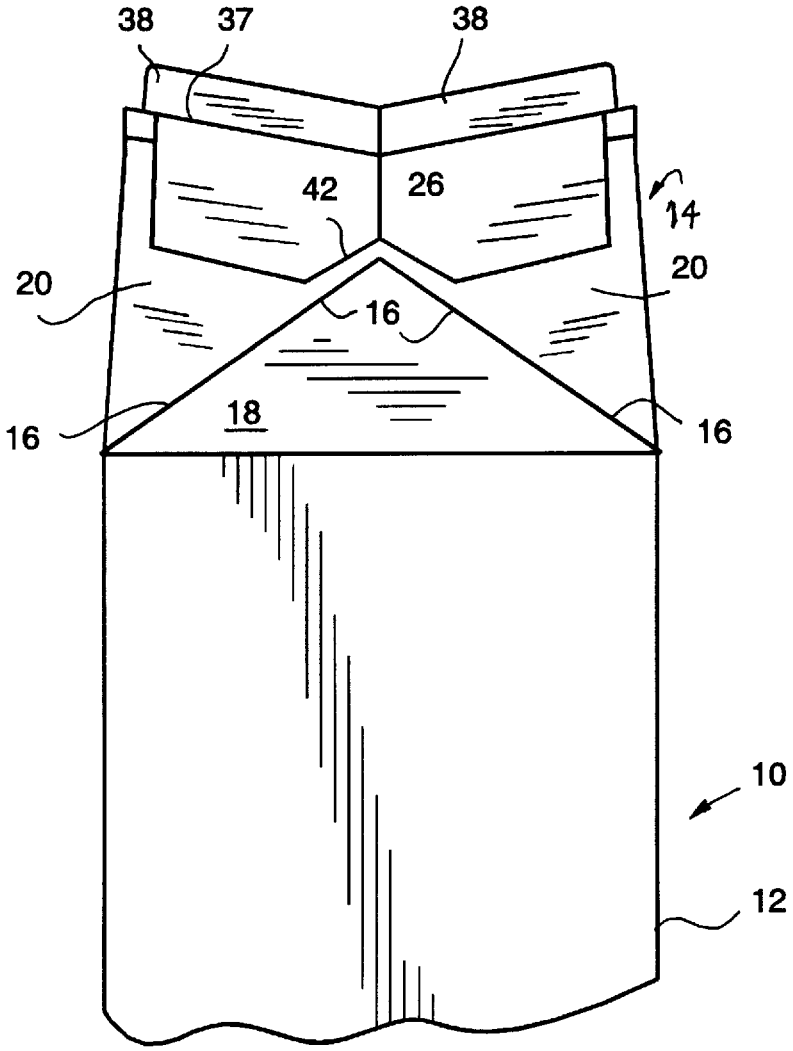
FIG. 6 is a front elevational view of an upper portion of the container of FIG. 5, showing the opening aid in a folded position.

Referring to FIGS. 5 and 6, the opening aid 126 can include a notch 42 in the center of an upper edge to control fluid flow. The notch 42 can be shaped to conform to the score lines 16 between the center and side panels 18, 20, when in the folded position.

Figure 7:
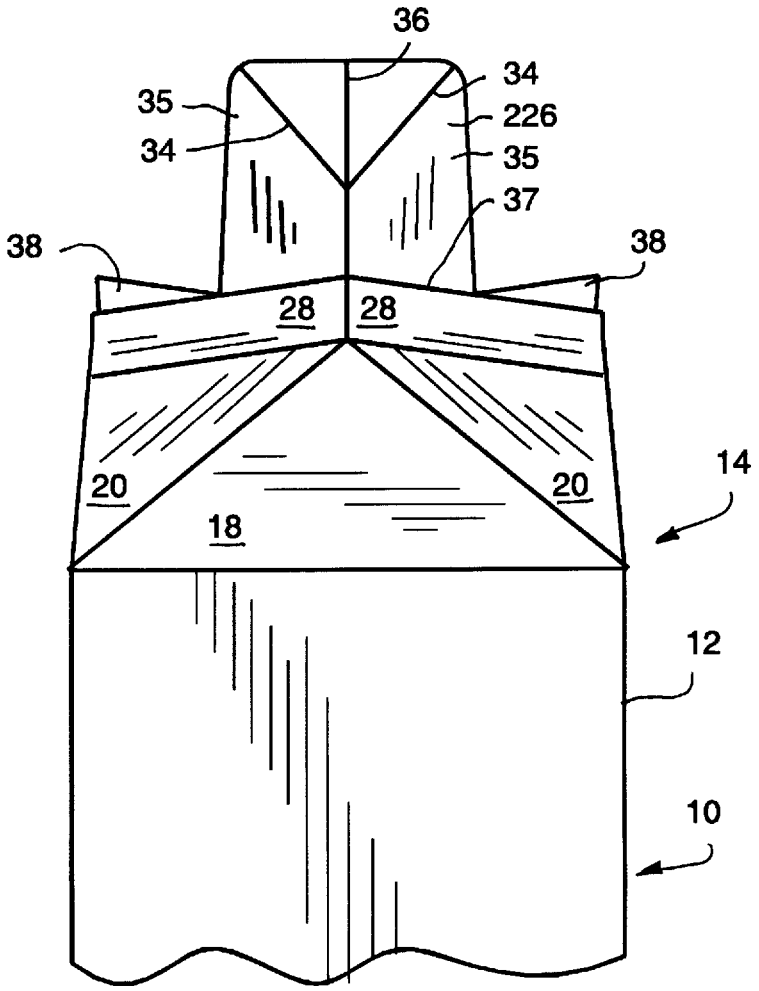
FIG. 7 is a cut away front elevational view of an upper portion of a third embodiment.
Figure 8:
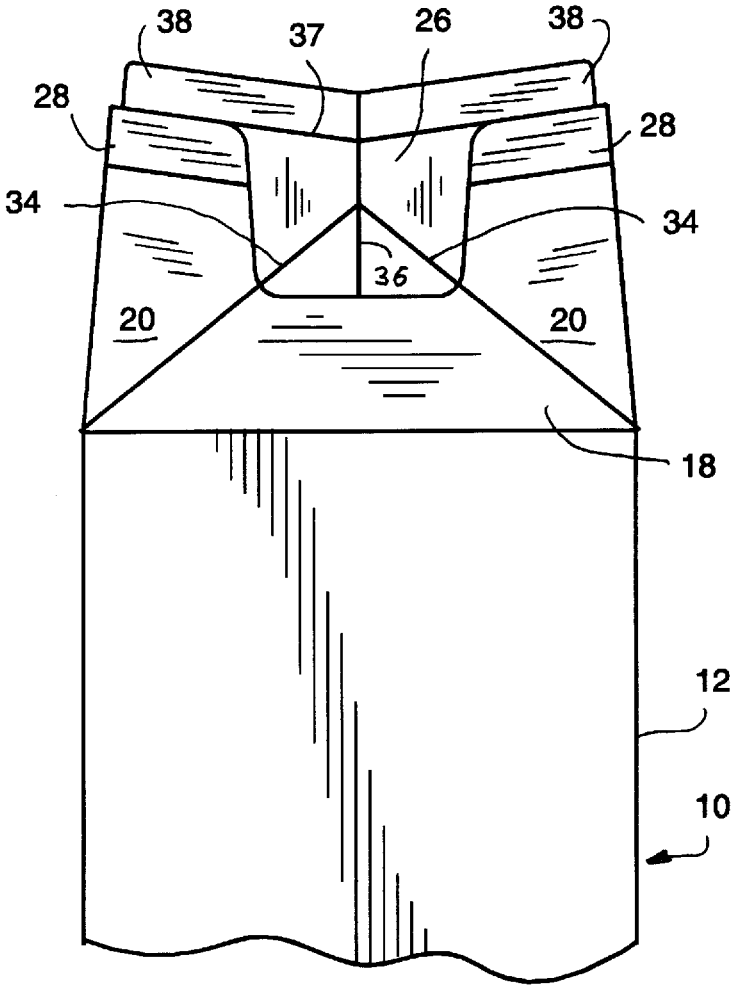
FIG. 8 is a cut away front elevational view of an upper portion of the container of FIG. 7, showing the opening aid in a folded position.

Referring to FIGS. 7 and 8, the opening aid 226 can extend upward from only a portion of the end panels 28 such that it forms a relatively narrow extension to the spout 15. Here the width of the opening aid 226 is shown to be approximately one quarter of the combined lengths of the end panels 28. However, it can be appreciated that the opening aid 226 can be wider. As with the embodiments described above, the opening aid 226 preferably includes score lines 34 and 36 to allow the opening aid 226 to fold into the gabled top 14 for closure, and to provide rigidity when extended.

While the invention has been described with respect to certain preferred embodiments, it is not intended to limit the scope of the invention thereby, but solely by the claims appended hereto.

What is claimed:

1. A beverage container, comprising:

(a) a reservoir and a folding gabled top connected to said reservoir, said top having an open position forming a pouring spout;

(b) said top including a plurality of front and rear panels, and including means on said front and rear panels to sealingly join said front panels to said rear panels for initial sealing closure of said beverage container; and (c) an opening aid comprising means for unsealing and separation of the front and rear panels to initially open said gabled top by the application of outward tensile force on said opening aid, said opening aid being hingedly connected to at least one of said front panels and pivotable between a first position, an intermediate second position and a third position; said opening aid is folded downward against said front panels to permit said initial sealing closure in said first position; said sealing aid extending approximately horizontally from said front panels when said unsealing means are enabled in said intermediate second position, said opening aid extending upwardly from a top edge of said front panels to provide an extension of said pouring spout to aid and direct fluid flow therethrough in said third position.

2. A beverage container as in claim 1, wherein:

(a) when said gabled top is in said open position, two front panels are aligned in a substantially v configuration forming an apex at a front of said pouring spout;

(b) said opening aid is connected to both said two front panels across said apex;

(c) when in said extended position, said opening aid includes a portion aligned with said apex; and (d) whereby said arcuate or V-shaped portion for imparting rigidity to said opening aid to provide support for liquid flowing thereover, and for forming a channel to direct fluid flow.

3. A beverage container as in claim 2, wherein:

(a) said gabled top includes score lines to permit folding closure of said top; and (b) said opening aid includes score lines to permit said opening aid to fold into said gable top, said score lines of said opening aid being aligned with said score lines of said gabled top when said opening aid is folded into said gabled top.

4. A beverage container as in claim 1, wherein said opening aid comprises an upper edge and an notch located on said upper edge, said notch being aligned with a center of said pouring spout when said opening aid is in said extended position.

5. A beverage container as in claim 4, wherein:

(a) said gabled top includes score lines to permit folding closure of said top; and (b) said notch has edges aligned with said score lines when said opening aid is folded into said gabled top.

6. A beverage container as in claim 1, wherein said opening aid extends substantially the entire width of a front portion of said pouring spout.

7. A beverage container as in claim 4, wherein said opening aid includes opposed sealing portions in sealing contact when said gabled top is sealed in said closed position.

8. A beverage container as in claim 2, wherein:

(a) said opening aid includes one or more score lines dividing said opening aid into a plurality of panels; and (b) one of said score lines is aligned with said apex.

9. A beverage container, comprising:

(a) a reservoir and a folding gabled top connected to said reservoir, said top having a closed position and an open position forming a pouring spout;

(b) said gabled top including a plurality of front and rear panels separated by hinge-forming score lines, and including means to sealingly join said front and rear panels for initial sealing closure of said beverage container;

(c) an opening aid connected to a top edge of at least one of said front panels and being hingedly supported relative thereto by a score line;

(d) said opening aid including a plurality of panels separated by one or more internal score lines; said internal score lines being aligned with corresponding score lines of said gabled top when said opening aid is folded downward against said front panels to permit folding closure of the top;

(e) said opening aid including an opening position wherein said panels thereof project substantially horizontally and away from said front panels to permit grasping thereof and to provide means for initially opening the top; and (f) said opening aid having a position wherein said opening aid forms an extension of a center portion of said pouring spout to aid and direct fluid flow therethrough.

* * * * *